US005152848A

United States Patent [19]

Ohma

[11] Patent Number: 5,152,848

[45] Date of Patent: Oct. 6, 1992

[54] HIGH TOUGHNESS STAINLESS STEELS AND THE METHOD OF PRODUCING THE SAME

[75] Inventor: Hideyuki Ohma, Aichi, Japan

[73] Assignee: Daido Tokushuko K.K., Aichi, Japan

[21] Appl. No.: 595,135

[22] Filed: Oct. 10, 1990

[30] Foreign Application Priority Data

Oct. 11, 1989 [JP] Japan ..... 1-264596

[51] Int. Cl.[5] ..... C21D 8/06; C22C 38/26

[52] U.S. Cl. ..... 148/609; 148/325; 420/70

[58] Field of Search ..... 148/12 EA, 32 S; 420/70

[56] References Cited

FOREIGN PATENT DOCUMENTS 2002815 2/1979 United Kingdom ..... 148/12 EA

OTHER PUBLICATIONS

Japanese Industrial Standard G 0555-1977.

*Primary Examiner*—Deborah Yee

*Attorney, Agent, or Firm*—Sughrue, Mion, Zinn, Macpeak & Seas

[57] ABSTRACT

A high toughness ferritic stainless steel having the excellent cold workability and the excellent heading workability suitable for the plastic working of screws, which consists essentially of, by weight percentage, C≦0.03%, P≦0.040%, S≦0.010%, Si≦1.0%, Mn≦1.0%, 11.5%≦Cr≦22.0%, 0.05%≦Nb≦0.80%, N≦0.025%, if necessary at least one selected from 0.2%≦Cu≦1.0%, 0.01≦Mo≦2.00%, 0.020%≦Ni≦1.50% and the balance being Fe and inevitable impurities, and the number of inclusions larger than 20 μm amoung inclusions composed of carbo-nitrides of Nb, Ti and/or Zr in the steel is not more than 20. In the production of the high toughness ferritic stainless steel, the rolling material having the above-mentioned chemical compositions is heated to 1200° C. or above at the rod rolling.

8 Claims, 2 Drawing Sheets

HIGH TOUGHNESS STAINLESS STEELS AND THE METHOD OF PRODUCING THE SAME

BACKGROUND OF THE INVENTION

1. Field of the Invention

This invention relates to ferritic stainless steel having an excellent toughtness and the method of producing the same, and more particularly to high toughness ferritic stainless steel excellet in the cold workability and suitable for use as materials of screws which are manufactured so as to form the heads by header prosessing (plastic working for the head of the screw) and to form the screw parts by, for example, rolling (plastic working for the screw body) and the method of producing the same.

2. Description of the Prior Art

Recent years, the consumption of screws manufactured by header processing and rolling has been increasing instead of screws made by machining process, and ferritic stainless steels have a tendency to be adopted as materials for the plastic-worked screws because of the cheapness and the excelletn corrosion resistance.

In the case of manufacturing the screws using such ferritic stainless steels as materials by the header processing and the rolling, though the conventional ferritic stainless steels have the excellent heading wokability, the neck-breakage resistance at the head portion of the cerew is not always sufficient even now because the head portion of the screw is subjected to heavy plastic deformation by the header processing. Accordingly, there is a problem since there is the possibility that the screw may be broken down at the head portion along the grain flow produced by the header processing.

SUMMARY OF THE INVENTION

Therefore, this invention is made in view of the aforementioned problem of the prior art, it is an object to provide a high toughness ferritic stainless steel which is excellent in the heading workability in the case of manufacturing the screw by the header processing and the rolling for example, and also excellent in the neck-breakage resistance of the screw head formed by the header processing. And another object of this invention is to provide a method for producing the high toughness ferritic stainless steel having excellent properties as described above.

The construction of the high toughness stainless steel according to this invention for attaining the aforementioned object is characterized in that it consists essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N, and if necessary at least one selected from 0.2 to 1.0 wt % of Cu, 0.01 to 2.00 wt % of Mo and 0.02 to 1.50 wt % of Ni, and the balance being Fe and inevitable inpurities, and the number of inclusons larger than 20 μm among inclusions composed of carbonitrides of Nb and, Ti and Zr contained as inevitable impurities is not more than 20 per 300 $mm^2$, and preferably a percentage of area of the carbo-nitrides is not more than 0.05%. And the construction of the method of producing the high toughness stainless steel according to this invention for attaining the aforementioned object is characterized by heating the stainless steel material having the aforementioned composition at a temperature of 1200 or above at the time of the rod rolling.

DETAILED DESCRIPTION OF THE INVENTION

Figure 1:
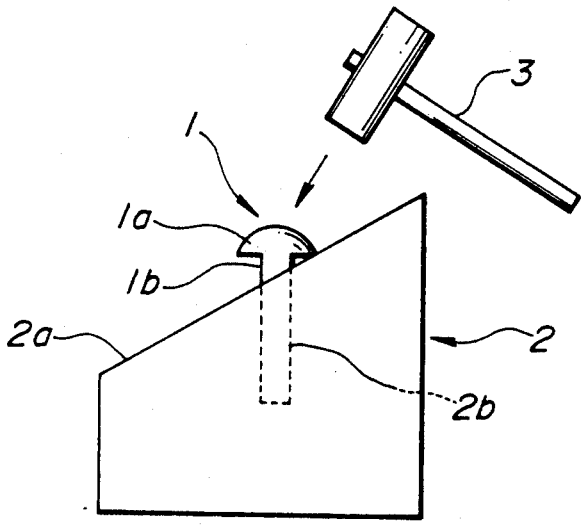
FIG. 1 is a schematic view illustrating the procedure of the neck-breakage resistance test for the screw head.

The reason why the chemical composition (by weight percetntage) of the high toughness stainless steel according to this invention is limited to the above range will be described below.

C: not more than 0.03%

C is an element conducive to improve the strength of the steel, but sometimes deteriorates the corrosion resistance by the formation of carbides combined with carbide forming elements such as Nb added, Ti and Zr contained as impurities, and so on because the precipitated carbides function as a starting point of the corrosion. And C lowers the effect of Nb by combining with Nb added and forming carbide NbC so that the C content is limited to not more than 0.03%.

P: not more than 0.040%

It is necessary to reduce the content of P as much as possible because p is deteriorates the cold workability of ferritic stainless steels and impairs the formability of the screw head by header processing, so that the P content is limited to not more than 0.040%.

S: not more than 0.010%

It is necessary to reduce the content of S as much as possible because S is deteriorates the cold workability of ferritic stainless steels and impairs the formability of the screw head by header processing, therefore the S content is limited to not more than 0.010%.

Si: not more than 1.0%

Although Si has a deozidation action in melting process of the steel and has an action for improving the oxidation resistance, the toughness is degraded if Si is contained too much so that the Si content is limited to not more than 1.0%.

Mn: not more than 1.0%

Mn has a deoxidation and desulfurization action in melting process of the steel and has an action for improving the mechanical properties. However if Mn is contained too much, the heading workability is harmed, so that the content of Mn is defined as not more than 1.0%.

Cr: 11.5 to 22.0%

Cr is an foundamental element of ferritic stainless steels, and is defined as not less than 11.5% in order to obtain the good corrosion resistance. However the Cr content is limited to not more than 22.0% because the workability is degraded and it becomes impossible to perform the forming of the screw head satisfactorily by the header processing when Cr is contained in excess.

Nb: 0.05 to 0.80%

Nb is an ellement effective for improving the toughness of ferritic stainless steels and improving the heading workability, and is defined as not less than 0.05%. However, if Nb is contained too much, the brittleness transition temperature becomes higher and the toughness is rather degraded, so that it is limited to not more than 0.80%.

N: not more than 0.025%

N changes into nitrides by combining with nitride former such as Nb added, Ti and Zr contained as impurities and the like, and the corrosion resistance is sometimes degraded because the precipitated nitrides function as a starting point of the corrosion. And the Nb added in the steel becomes ineffective since the nitride NbN is formed by combining Nb with N, so that the content of N is limited to not more than 0.025%.

Cu: 0.2 to 1.0%, Mo: 0.01 to 0.50%, Ni: 0.02 to 1.50%

Cu, Mo and Ni are elements conductive to improve the corrosion resistance of ferritic stainless steels, it is preferably to contain at least one selected from not less than 0.2% of Cu, not less than 0.01% of Mo and not less than 0.02% of Ni at need. However, if these elements are contained too much, the workability, the toughness and the ductility are degraded, especially the strength is improved in excess and the formability of the screw head by the header processing is deteriorated when Mo is contained too much. Therefore, it is necessary to limit the Cu content to not more than 1.0%, the Mo content to not more than 2.00%, and the Ni content to not more than 1.50% in case of containing these elements.

The high toughness stainless steel according to this invention has the abovementioned chemical compositions, and the number of inclusions larger than 20 μm among inclusions composed of carbo-nitrides of Nb and, Ti and Zr contained as inevitable impurities is not more than 20 per 300 $mm^2$ in the stainless steel for the reason that the screw becomes easy to be broken down by occurence of cracks starting from coarse carbon-nitrides at the head portion formed by header processing and the neck-breakage resistance is degraded when the number of coarse-granular inclusions larger than 20 μm are not more than 20 per 300 $mm^2$, which are observed in accordance with "Microscopic Testing method for the Non-metallic inclusions in Steel" prescribed in Japanese Industrial Standard G-0555.

And, it is possible to further improve the heading workability by decreasing an area percentage of the carbo-nitrides (total of $B_2$ type inclusions and $C_2$ type inclusions prescribed by JIS G 0555) into not more than 0.05% preferably.

Furthermore, in the method of producing the high toughness stainless steel according to this invention, a temperature at the time of rolling the high toughness stainless steel for header processing having above-mentioned compositions (extracting temperature of the rolling material) is made higher into 1200° C. or above, and is kept for 5 to 20 minutes or so preferably so as not to precipitate the carbo-nitrides such as Nb (C,N), Ti (C,N) and Zr (C,N) detected as $B_2$ type inclusions and $C_2$ type inclusions by dissolving the carbo-nitrides in the rolling material perfectly.

The high toughness stainless steel according to this invention has the aforementioned construction, therefore it is excellent in the neck-breakage resistance at the screw head formed by the header processing as wll as the heading wokability by controlling the amount of the carbo-nitrides in the steel.

EXAMPLE

Each of ferritic stainless steels having chemical compositions shown in Table 1 was melted and then cast into ingots. Each ingots was heated at respective extracting temperatures as shown in table 2 and kept at the temperatures for 20 minutes, and then was rolled into wire rods with diameters of 4.0 mm. And the wire rods were coiled up at coiling temperatures shown also in Table 2. Further, some of them were anealed under conditions shown in Table 2 after the rolling.

Next, the number of inclusions larger than 20 μm which are contained in the rolled wire rod and composed of carbo-nitrides Nb (C,N), Ti (C,N), Zr (C,N) was measured per 300 $mm^2$ in accordance with "Microscopic Testing Method for Non-Metallic inlusions in steel" prescribed in JIS G 0555. The results are shown also in table 2. And percentage of the total area of $B_2$ type inclusions (inclusions composed of carbo-nitrides of Nb, Ti and Zr among B type inclusions) and $C_2$ type inclusions (inclusions composed of carbo-nitrides of Nb, Ti and Zr among C type inclusions) prescribed in JIS G 0555 was investigated. The results are shown in Table 2.

Subsequently, fifty screw materials having head portions were prepared as specimeans from the respective rolled wire rod by header processing. Then the screw material 1 was set into a hole 2*b* of a jig 2 having an inclined slope 2*a* by 30 degrees as shown in FIG. 1, and neck-breakage resistance test was carried out by striking a head portion 1*a* of the screw material 1 with a hummer 3 and bending the screw material at a shank 1*b* just under the head portion 1*a*. After the bending, an appearance of the breakage at the neck portion of respective screw material 1 was investigated by macroscopic observation. The observed results are also shown in Table 2.

Figure 2:
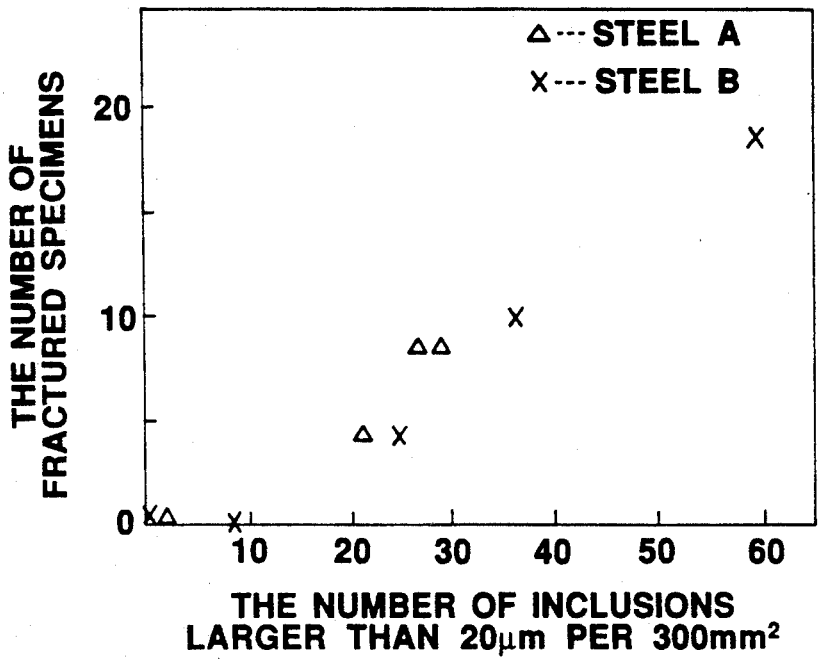
FIG. 2 is a graph exemplifying the relationship between the number of inclusions larger than 20 μm and the number of broken specimens among fifty tested specimens.
Figure 3:
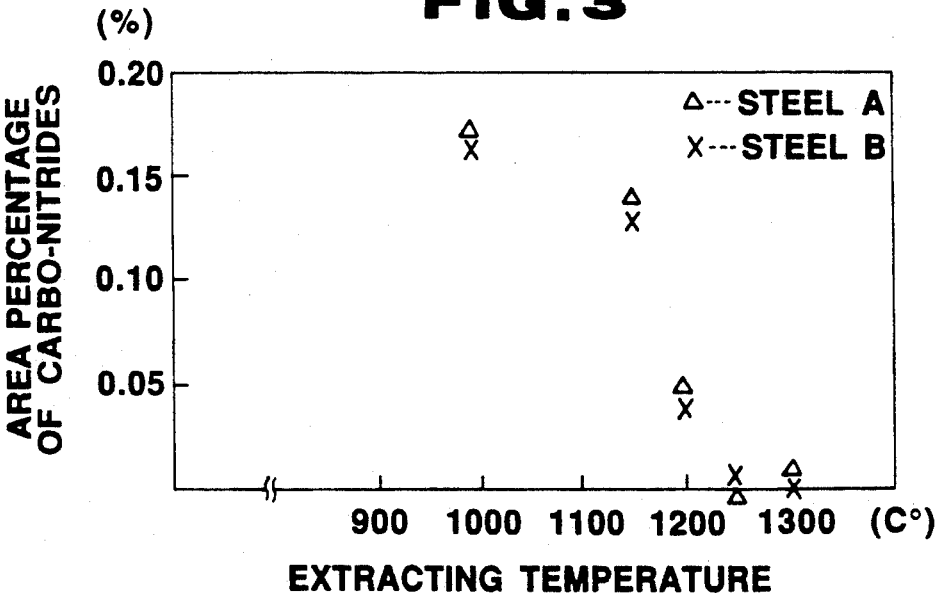
FIG. 3 is a graph exemplifying the relationship between the temperature at the time of rolling and the precentage of area of the carbon-nitrides.

As the results obtained by such investigations, the relationship between the number of inclusions larger than 20 μm and the number of fractured specimens among tested fifty specimens is shown in FIG. 2, and the relationship between the temperature of the rolling material (extracting temperature) and the percentage of area of carbo-nitrides ($B_2$ type inclusions and $C_2$ type inclusions) is shown in FIG. 3.

TABLE 1

| Kind of steel | | Chemical composition (wt %) | | | | | | | | | | | |
|---|---|---|---|---|---|---|---|---|---|---|---|---|---|
| | | C | P | S | Si | Mn | Cr | Nb | Cu | Ni | N | O | Fe |
| Example | A | 0.010 | 0.033 | 0.005 | 0.35 | 0.41 | 19.50 | 0.40 | — | — | 0.015 | 0.015 | bal. |
| | B | 0.009 | 0.037 | 0.003 | 0.23 | 0.33 | 20.05 | 0.38 | 0.38 | 0.31 | 0.020 | 0.017 | bal. |
| Comparative | C | 0.008 | 0.035 | 0.004 | 0.31 | 0.35 | 18.80 | 0.02 | — | — | 0.021 | 0.016 | bal. |
| example | D | 0.006 | 0.036 | 0.003 | 0.28 | 0.36 | 19.70 | 1.21 | — | — | 0.016 | 0.018 | bal. |

TABLE 2

| No. | Kind of steel | Manufacturing conditions: Rolling conditions: Extracting temperature (kept for 20 min.) (°C.) | Coiling temperature (°C.) | Anealing temperature (°C.) | The number of inclusions larger than 20 μm (the number/300 mm²) | Area percentage of $B_2$ and $C_2$ type inclusions (%) | Heading workability | The number of fractured spesimens (the number/50) |
|---|---|---|---|---|---|---|---|---|
| 1 | A | 1000 | 805~830 | — | 27 | 0.17 | good | 8 |
| 2 | A | 1000 | 805~830 | 780 | 29 | 0.17 | good | 8 |
| 3 | A | 1150 | 805~830 | — | 21 | 0.14 | good | 4 |
| 4 | A | 1200 | 803~860 | — | 0 | 0.05 | good | 0 |
| 5 | A | 1250 | 870~900 | — | 0 | 0 | good | 0 |
| 6 | A | 1300 | 915~985 | — | 0 | 0 | good | 0 |
| 7 | B | 1000 | 805~830 | — | 36 | 0.17 | good | 10 |
| 8 | B | 1000 | 805~830 | 780 | 60 | 0.17 | good | 18 |
| 9 | B | 1150 | 805~830 | — | 25 | 0.13 | good | 4 |
| 10 | B | 1200 | 830~850 | — | 9 | 0.04 | good | 0 |
| 11 | B | 1250 | 870~900 | — | 0 | 0.01 | good | 0 |
| 12 | B | 1300 | 915~985 | — | 0 | 0 | good | 0 |
| 13 | C | 1250 | 880~905 | — | 0 | 0 | almost good | — |
| 14 | D | 1250 | 870~900 | — | 0 | 0 | no good | — |

As shown in Table 2 and FIG. 2, the number of fractured specimens increases as the number of coarse carbo-nitrides larger than 20 μm increases, and it is confirmed as shown in Table 2 and FIG. 3 that the number of the coarse carbo-nitrides larger than 20 μm decreases into not more than 20 and the neck-breakage of the screw material is solved by making the temperature at the rolling higher to 1200° C. or above.

As described above, the high toughness stainless stell according to this invention is a ferritic stainless steel having specified chemical composition including Cr and Nb, and is so controlled that the number of inclusions larger than 20 μm among inclusions composed carbo-nitrides of Nb and, Ti and Zr contained as inevitable impurities may be not more than 20 per 300 mm². Therefore, it has high toughness and is excellent in the cold workability, especially in the heading workability and the neck-breakage resistance at the screw head in the case in which the screw is manufactured by header processing. And an excellent effect can be obtained since it is suitable to be used as a material for making screws with high reliability by plastic working. And another excellent effect can be obtained since it is possible to produce the high toughness stainless steel having aforementioned good characteristics by the method of producing the high toughness stainless steel according to this invention.

What is claimed is:

1. A high toughness ferritic stainless steel consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N and the balance being Fe and inevitable impurities, and the number of inclusions larger than 20 μm among inclusions composed of carbo-nitrides of Nb and, Ti and Zr contained as inevitable impurities being not more than 20 per 300 mm².

2. A high toughness ferritic stainless steel consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N, at least one selected from 0.2 to 1.0 wt % of Cu, 0.01 to 2.00 wt % of Mo and 0.02 to 1.50 wt % of Ni and the balance being Fe and inevitable impurities, and the number of inclusions larger than 20 μm among inclusions composed of carbo-nitrides of Nb and, Ti and Zr contained as inevitable impurities being not more than 20 per 300 mm².

3. A high toughness ferritic stainless steel as set forth in claim 1, wherein a percentage of area of total carbonitrides is not more than 0.05%.

4. A high toughness ferritic stainless steel as set forth in claim 2, wherein a percentage of area of total carbonitrides is not more than 0.05%.

5. A method of producing a high toughness ferritic stainless steel as set forth in claim 1, by heating a ferritic stainless steel material consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 % of Cr, 0.05 to 0.80 wt % of Nb, not more than 0.025 wt % of N and the balance being Fe and inevitable impurities at a temperature of 1200° C. or above at the time of the rod rolling.

6. A method of producing a high toughness ferritic stainless steel as set forth in claim 2, by heating a ferritic stainless steel material consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N, at least one selected form 0.2 to 1.0 wt % of Cu, 0.01 to 2.00 wt % of Mo and 0.02 to 1.50 wt % of Ni and the balance being Fe and inevitable impurities at a temperature of 1200° C. or above at the time of the rod rolling.

7. A method of producing a high toughness ferritic stainless steel as set forth in claim 3, by heating a ferritic stainless steel material consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N and the balance being Fe and inevitable impurities at a temperature of 1200° C. or above at the time of the rod rolling.

8. A method of producing a high toughness ferritic stainless steel as set forth in claim 4, by heating a ferritic stainless steel material consisting essentially of not more than 0.03 wt % of C, not more than 0.040 wt % of P, not more than 0.010 wt % of S, not more than 1.0 wt % of Si, not more than 1.0 wt % of Mn, 11.5 to 22.0 wt % of Cr, 0.05 to 0.80 wt % of Nb, not more than 0.025 wt % of N, at least one selected form 0.2 to 1.0 wt % of Cu, 0.01 to 2.00 wt % of Mo and 0.02 to 1.50 wt % of Ni and the balance being Fe and inevitable impurities at a temperature of 1200° C. or above at the time of the rod rolling.

* * * * *